United States Patent [19]

Kaveney, Jr.

[11] Patent Number: 4,763,934

[45] Date of Patent: Aug. 16, 1988

[54] DOOR LATCH AND LOCK ASSEMBLY

[75] Inventor: John R. Kaveney, Jr., East Peoria, Ill.

[73] Assignee: Caterpillar Inc., Peoria, Ill.

[21] Appl. No.: 938,107

[22] Filed: Dec. 4, 1986

[51] Int. Cl.[4] ..... E05B 55/04

[52] U.S. Cl. ..... 292/21; 292/92; 292/48; 292/DIG. 23; 292/DIG. 65; 70/484; 70/92; 70/152; 70/489

[58] Field of Search ..... 292/48, 21, 92, 152, 292/196, 210, 216, 280, 336.3, DIG. 23, DIG. 26, DIG. 65; 70/467, 470, 478–481, 483–486, 489, 152, 153, 210, 92

[56] References Cited

U.S. PATENT DOCUMENTS

| | | | |
|---|---|---|---|
| 1,908,958 | 5/1933 | Coffron | 292/169.16 |
| 3,095,724 | 7/1963 | Truhon | 292/152 X |
| 3,336,066 | 8/1967 | Knapp | 292/DIG. 65 |
| 3,386,760 | 6/1968 | Bessette | 292/DIG. 65 |
| 3,666,035 | 5/1972 | Schlichter | 292/DIG. 65 |
| 3,670,536 | 6/1972 | Klebba | 70/485 X |
| 3,698,215 | 10/1972 | Truhon | 70/152 |
| 3,750,433 | 8/1973 | Sanders | 70/486 |
| 3,999,789 | 12/1976 | Maurits et al. | 272/DIG. 65 |
| 4,049,305 | 9/1977 | Zetterlund et al. | 292/336.3 |
| 4,277,964 | 7/1981 | Crabb et al. | 70/484 |
| 4,363,231 | 12/1982 | Kaveney, Jr. | 70/484 |
| 4,371,205 | 2/1983 | Kaveney, Jr. | 292/48 |
| 4,430,451 | 11/1984 | Fujiya | 70/92 |
| 4,487,441 | 12/1984 | Miyamoto et al. | 292/216 X |
| 4,594.864 | 6/1986 | Hart | 70/489 X |

*Primary Examiner*—Gary L. Smith
*Assistant Examiner*—Eric K. Nicholson
*Attorney, Agent, or Firm*—Calvin E. Glastetter

[57] ABSTRACT

Door lock and lock assemblies are useful, for example, in vehicle cabs. Latch and lock assemblies of known structures which can be unlocked from the inside the cab while remaining locked from outside the cab require complex and bulky linkage assemblies. The subject door latch and lock assembly includes pivotal outer and inner actuator. The pivotal movement of the outer actuator simultaneously pivots the inner actuator to open a catch mechanism. Pivot movement of the inner actuator can be independent of the outer actuator. A locking level can be pivoted to a locked position to prevent pivotal movement of the outer actuator. Pivotal movement of the inner actuator is not prevented by the locking level. Thus, the disclosed door latch and lock assembly ca be opened from inside the cab while remaining locked from outside the cab without requiring complex and bulky linkage assemblies.

3 Claims, 4 Drawing Sheets

19
30
34
17
29
58
50
96
42
40
90
76
66
104
88
48
92
112
82
52
84
106
58
80
114
32
42
102
60
108
116
110
100
98
V
V

DOOR LATCH AND LOCK ASSEMBLY

DESCRIPTION

1. Technical Field

This invention relates to a door latch and lock assembly and more particularly to a linkage assembly operative from inside a vehicle cab while being locked from the outside.

2. Background Art

Many cabs on earthmoving vehicles and the like have door latch and lock assemblies locked from the outside using a key. In some of such door latch and lock assemblies the latch mechanism cannot be operated from inside the cab without first unlocking the lock mechanism from outside the cab. Other of such latch and lock assemblies which are key locked from the outside and have a lever inside the cab which must be moved to the unlocked position before the latch mechanism can be opened. The use of the lever requires the latch and lock assembly to have complex and bulky linkage mechanism and does not allow the latch and lock assembly to remain locked from the outside when opened from the inside.

U.S. Pat. No. 4,277,964 to Crabb shows a door lock assembly which has a lock release lever which extends into the cab. The lower body of the lever has a notch in which an ear may be received to lock and prevent the outside handle from turning. The lever has a cam surface which is contacted by a shoulder, while the inside handle is turned, to pivot the lever to an unlocked position. In this lock assembly the linkage assembly is complex and bulky and the outside handle is not prevented from rotation when the door is opened by the inside handle.

U.S. Pat. No. 4,363,231 to Kaveney shows a door lock assembly which has a lock release handle connected to a locking cam. In the locked condition turning of the inside handle moves the locking cam to the unlocked position and allows the outside handle to turn. In this lock assembly the linkage assembly is complex and bulky and the outside handle is not prevented from rotation when the door is opened by the inside handle.

DISCLOSURE OF THE INVENTION

In one aspect of the present invention a door latch and lock assembly is provided to permit a door to be releasably latched to a striker on a door frame. A support structure is connected to the door. A catch mechanism is connectable to the support structure and is actuatable to a closed condition engageable with the striker and an open condition disengaged from the striker. An inner actuator is pivotally mounted on the support structure. Connecting means is provided for connecting the inner actuator to the catch mechanism. An outer actuator is pivotally mounted on the support structure. A means is provided for simultaneous pivotal movement of the inner actuator when the outer actuator is pivoted and also allowing pivotal movement of the inner actuator independent of the outer actuator. A key lock assembly having a lock member is movable between a locked position preventing movement of the outer actuator and an unlocked position which allows movement of the outer actuator.

BEST MODE FOR CARRYING OUT THE INVENTION

Figure 1:
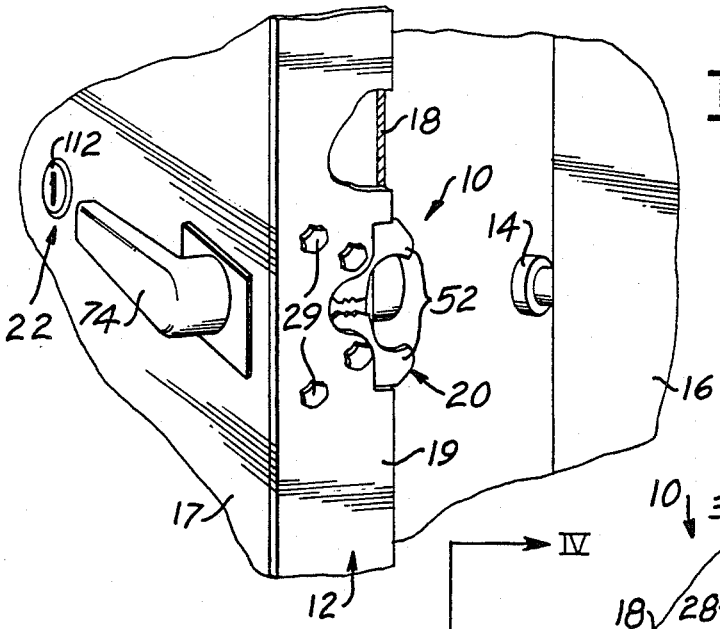
FIG. 1 is a partial perspective view of a door latch and lock assembly with a door frame.
Figure 2:
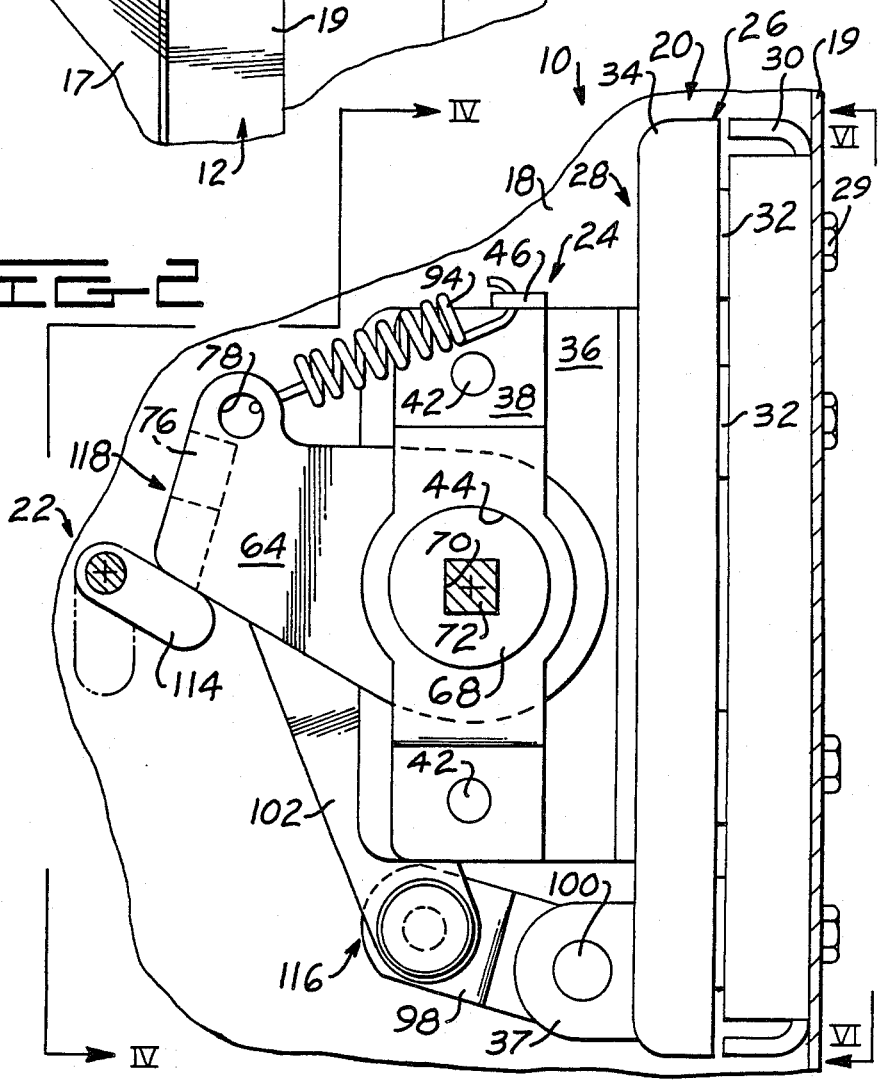
FIG. 2 is a side view of the door latch and lock assembly with the outer door panel broken away.

A door latch and lock assembly 10 is shown in FIG. 1 mounted inside a door, partially shown at 12, of a vehicle cab. A striker 14 is mounted on a door frame, partially shown at 16, of the cab for engagement by the door latch and lock assembly when the door is closed. The door has spaced apart outer 17 and inner 18 side panels and an end plate 19.

Figure 6:
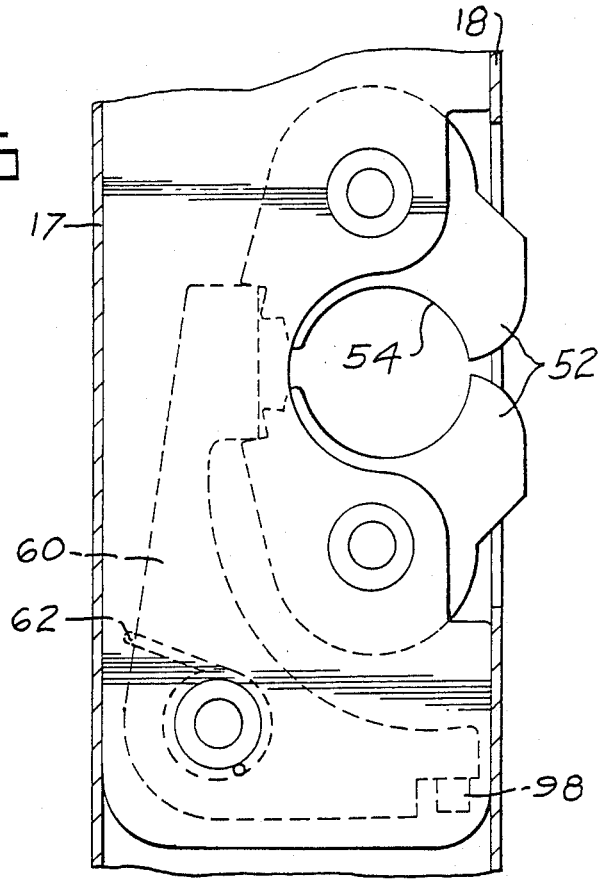
FIG. 6 is an end view of the door latch and lock assembly as shown by line VI—VI of FIG. 2.

The door latch and lock assembly 10 includes a latch mechanism 20, and a lock mechanism 22 as best shown in FIGS. 2–5. The latch mechanism includes a linkage assembly 24 and a catch mechanism 26. The catch mechanism 26 includes a support structure 28 suitably connected to the end plate 19 by a plurality of fasteners 29. The support structure 28 is a multipiece assembly having a first support member 30 connected to an end of a plurality of cylindrical pins 32, a second support member 34 and a support plate 36 connected to an opposite end of the plurality of cylindrical pins 32. A tang 37 projects from the second support member 34. An outer bracket 38 and an inner bracket 40 are attached to the support plate 36 by a plurality of fasteners 42. The outer bracket 38 has a circular aperture 44 and a tang 46 projecting therefrom. The inner bracket 40 has a circular aperture 48 and a tang 50 projecting therefrom. The catch mechanism 26 has a pair of pawls 52, positioned between the first support member 30 and the second support member 34, each pivotally connected on one of the plurality of pins 32. The pawls 52 form a circular enclosure 54 for engaging the striker 14 and include detents 56, as best shown in FIG. 6. A pair of torsion springs 58 urge the pawls 52 to an open position, as shown in FIG. 1. A release lever 60 is pivoted on one of the plurality of pins 32. A torsion spring 62 urges the release lever 60 into engagement with the detents 56 of the pair of pawls 52 when the pawls 52 are in the closed condition as shown in FIG. 6. The engagement of the release lever 60 with the detents 56 of the pawls 52 will maintain the pawl 52 in the closed position.

The linkage assembly 24 includes an outer actuator 64 adjacent the outer door panel 17, and an inner actuator 66 adjacent the inner door panel 18. The outer actuator 64 at one end has a boss 68 pivotally extending through the circular aperture 44 of the outer bracket 38. A square aperture 70 in the boss 68 receives a square shaft portion 72 of an outside handle 74. The other end of the outer actuator 64 has a lug 76 projecting toward the inner actuator 66 and an aperture 78. The inner actuator 66 at one end has a boss 80 pivotally extending through the circular aperture 48 of the inner bracket 40. A square aperture 82 in the boss 80 receives a square shaft portion 84 of an inside handle 86. The other end of the inner actuator 66 has a lug 88 projecting toward the outer actuator 64 and an aperture 90. The lugs 76,88 are positioned for abutment with each other. A pin 92 is connected to the inner actuator 66 intermediate the boss 80 and the lug 88. A spring 94 is connected between the aperture 78 of the outer actuator 64 and the tang 46 of the outer bracket 38. A spring 96 is connected between the aperture 90 of the inner actuator 66 and the tang 50 of the inner bracket 40. An actuating lever 98 is pivotally mounted by a pin 100 to the tang 37 of the second support member 34 and contacts the release lever 60. An actuating link 102 extends between the inner actuator 66 and the actuating lever 98. A first end portion 104 of the actuating link 102 contains a slot 106 through which the pin 92 of the inner actuator 66 extends . A second end portion 108 of the actuating link 102 is pivotally attached by a pin 110 to the actuating lever 98.

The lock mechanism 22 includes a key tumbler 112 which extends through the outer door panel 17 and a rotatable locking lever 114 positionable between a locked position abutting the outer actuator 64 and an unlocked position rotated away from the outer actuator 64.

The actuating lever 98 and actuating link 102 constitute a means 116 for connecting the inner actuator 66 to the catch mechanism 26. The lug 76 of the outer actuator 64 an the lug 88 of the inner actuator 66 constitute a means 118 for causing simultaneous pivotal movement of the inner actuator 66 when the outer actuator 64 is pivoted and for allowing pivotal movement of the inner actuator 66 independent of the outer actuator 64.

INDUSTRIAL APPLICABILITY

The door latch and lock assembly 10 enables an operator to manipulate the inside door handle 86 to release the catch mechanism 26 and allow the door 12 to be opened with the locking lever 114 in either the locked or unlocked position. Rotation of the inside door handle 86 to release the catch mechanism 26 does not unlock the outside door handle 74. When the locking lever 114 of the lock mechanism 22 is in the locked position rotation of the outside handle 74 and outer actuator 64 is prevented.

Figure 3:
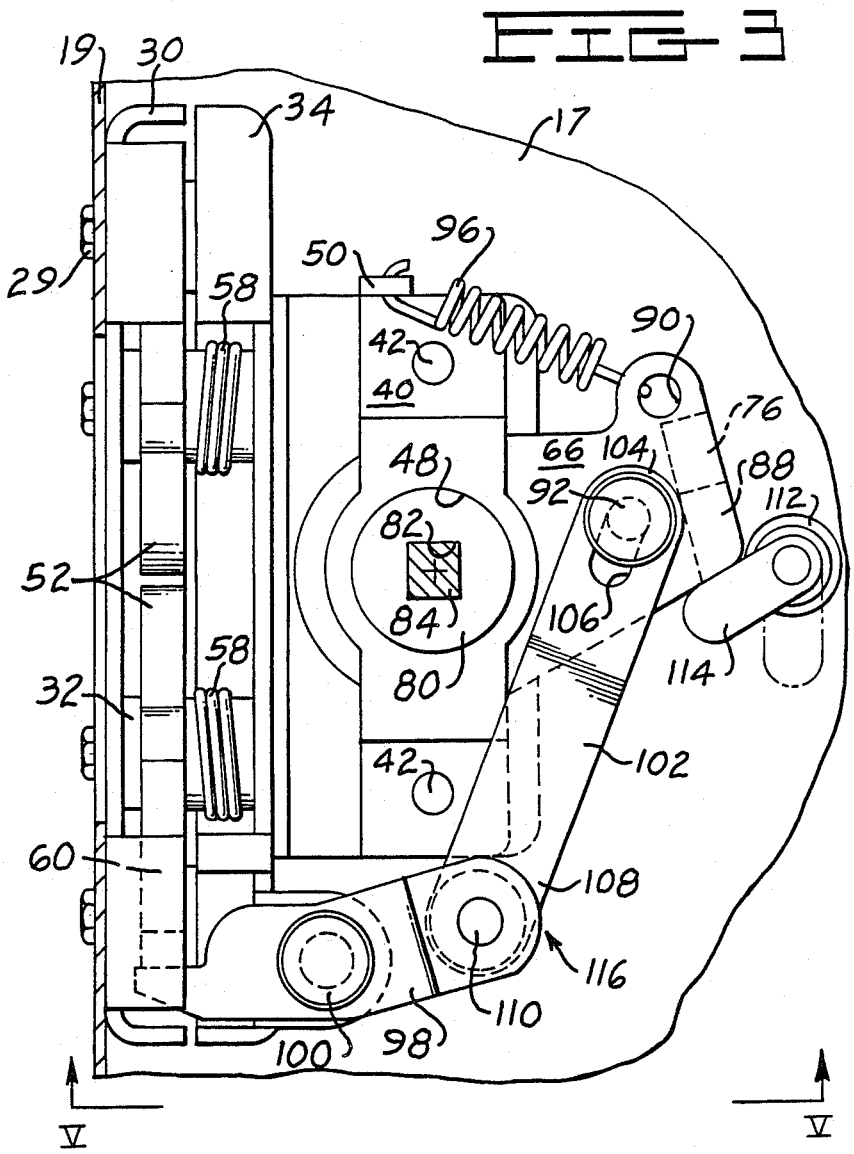
FIG. 3 is a side view of the door latch and lock assembly with the inner door panel broken away.
Figure 4:
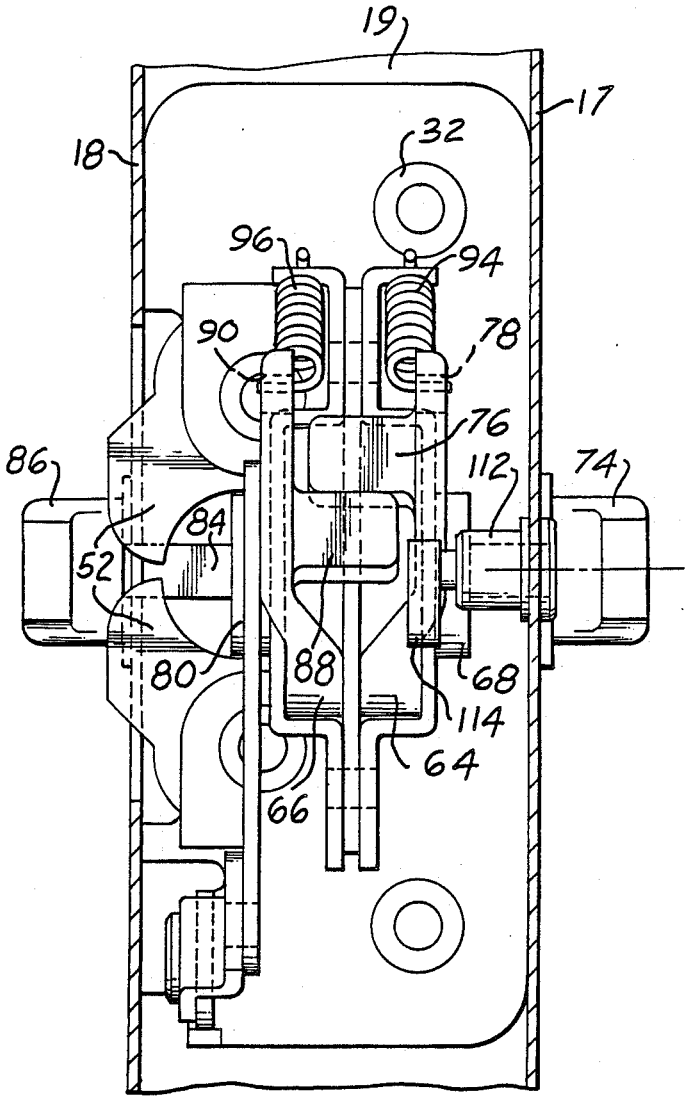
FIG. 4 is an end view of the door latch and lock assembly as shown by line IV—IV of FIG. 2.
Figure 5:
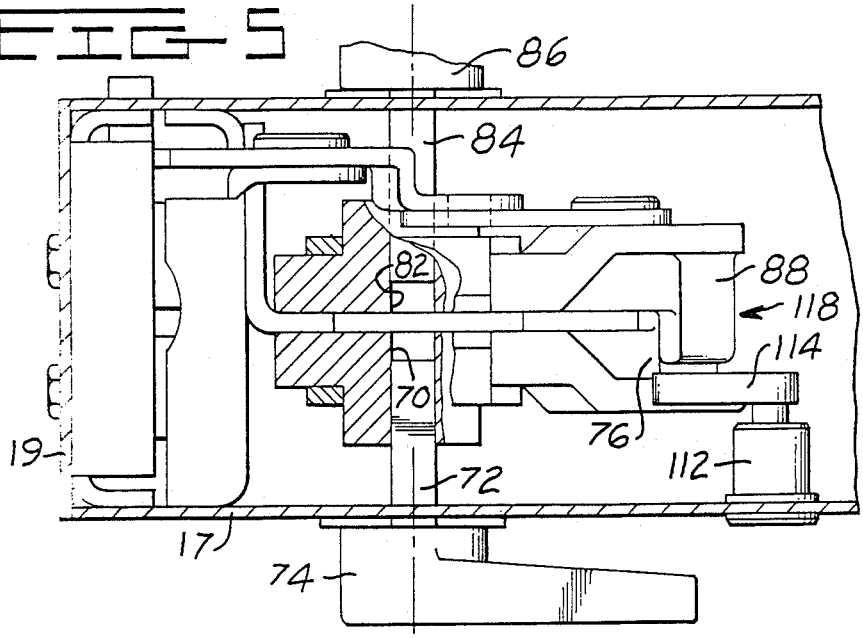
FIG. 5 is a bottom view of the door latch and lock assembly as shown by line V—V of FIG. 3.

The inside door handle 86 operates the door latch and lock assembly 10 as follows. Pushing down on the inside door handle 86 will rotate the inner actuator 66 with pin 92 moving in slot 106 of the actuating link 102. When the pin 92 contacts the end of the slot 106 of the actuating link 102 is pushed downward. Downward movement of the actuating link 102 causes the actuating lever 98 to pivot and move the release lever 60. Pivotal movement will disengage the release lever 60 from the detents 56 and allow the spring 58 to open the pawls 52. The inside door handle 80 can be rotated with the locking lever 114 in either the locked position or the unlocked position. The outer actuator 64 is maintained in the position shown in FIG. 2 by the spring 94. When the inside door handle 86 is released, the spring 96 will rotate the inner actuator 66 to its original position as shown in FIG. 3. If the locking lever 114 is in the locked position and the door 12 is closed again the locking lever 114 remains in the locked position thus preventing rotation of the outside handle 74.

In the unlocked condition the outside door handle 74 operates the door latch and lock assembly 10 as follows. Pushing down on the outside door handle 74 will rotate the outer actuator 64. Rotation of the outer actuator 64 causes lug 76 to abut lug 88 of the inner actuator 66 to simultaneously rotate the inner actuator 66. Continued rotation of the inner actuator 66 will open the pawls 52 of the catch mechanism 26 as previously described.

In the locked condition downward rotation of the outside door handle 74 is prevented, but downward rotation of the inside door handle 86 will open the pawls 52, as described previously, independent of the outer actuator 64.

To allow the door latch and lock assembly 10 to be operated from outside the cab, a key is inserted into the key tumber 112 and turned clockwise. Clockwise turning of the key rotates the locking lever 114 away from abutting engagement with the outer actuator 64 to allow the outside handle 74 to rotate. To prevent rotation of the outside handle 74, the key is inserted into the key tumbler 112 and rotated counterclockwise to move the locking lever 114 to its locking position abutting the outer actuator 64. Rotation of the locking lever 114 to the locked position only prevents rotation of the outer actuator 64 thus allows the inner actuator 66 to rotate even in the locked condition.

In view of the foregoing, it is readily apparent that the structure of the present invention provides an improved and more compact door latch and lock assembly which is less complex or bulky and can be opened from inside a vehicle cab while maintaining the locking lever in the locked position thus preventing rotation of the outside handle.

Other aspects, objects and advantages of this invention can be obtained from a study of the drawing, the disclosure and the appended claims.

I claim:

1. A door latch and lock assembly adapted to be connected, in use, to a door to permit the door to be releasably latched to a frame having a striker thereon, the door latch and lock assembly comprising:

a support structure connectable to the door;

a catch mechanism connected to support structure and actuatable to a closed condition for latching engagement with the striker and an open condition for disengagement from the striker;

an inner actuator mounted on the support structure for pivotal movement about a central axis;

means for connecting the inner actuator to the catch mechanism;

an outer actuator mounted on the support structure for pivotal movement about the central axis;

means for causing simultaneous pivotal movement of the inner actuator when the outer actuator is pivoted and allowing pivotal movement of the inner actuator independent of the outer actuator, said pivotal means includes a lug on the outer actuator projecting laterally toward the inner actuator and a lug on the inner actuator projecting laterally toward the outer actuator and being positioned for abutment with each other; and a key lock assembly connectable to the door, said key lock assembly having a locking lever movable between a locked position for preventing pivotal movement of the outer actuator and an unlocked position allowing pivotal movement of the actuator, wherein said locking lever, when in the locked position, remains in the locked position during pivotal movement of the inner actuator.

2. The door latch and lock assembly of claim 1 wherein the support structure is a multipiece assembly having first and second support members and a support plate.

3. The door latch and lock assembly of claim 1 wherein the connecting means includes an actuating lever pivotally connected to the support structure and an actuating link pivotally connected to the inner actuator and the actuating lever.

* * * * *

UNITED STATES PATENT AND TRADEMARK OFFICE

CERTIFICATE OF CORRECTION

PATENT NO. : 4,763,934

DATED : August 16, 1988

INVENTOR(S) : John R. Kaveney, Jr.

It is certified that error appears in the above-identified patent and that said Letters Patent is hereby corrected as shown below:

Cover page, In the Abstract, line 14, "level" should be --lever--.

Cover page, In the Abstract, line 15, "ca" should be --can--.

Claim 1, Column 4, line 33, after "to" insert --the--.

Claim 1, Column 4, line 47, after "pivotal" insert --movement--.

Signed and Sealed this

Tenth Day of January, 1989

*Attest:*

DONALD J. QUIGG

*Attesting Officer*

*Commissioner of Patents and Trademarks*